United States Patent [19]

Caseley

[11] Patent Number: 4,532,947

[45] Date of Patent: Aug. 6, 1985

[54] FILTER FOR REDUCING THE TOXIC EFFECTS OF CIGARETTE TOBACCO SMOKE

[75] Inventor: Jane R. Caseley, Withyham, England

[73] Assignee: Windleshaw Enterprises Limited, East Sussex, England

[21] Appl. No.: 610,084

[22] Filed: May 9, 1984

[30] Foreign Application Priority Data

May 12, 1983 [GB] United Kingdom ..... 8313044

[51] Int. Cl.[3] ..... A24D 1/18; A24D 3/00; A24D 3/02; A24D 3/06

[52] U.S. Cl. ..... 131/331; 131/334; 131/342; 423/245 S; 423/236

[58] Field of Search ..... 131/331, 334, 342, 344; 423/245 S, 236; 55/524, 387

[56] References Cited

U.S. PATENT DOCUMENTS

| | | | |
|---|---|---|---|
| 2,707,959 | 5/1955 | Shelanski | 423/245 S |
| 2,739,598 | 3/1956 | Eirich | 423/245 S |
| 2,754,829 | 7/1956 | Hess | 423/245 S |
| 2,800,908 | 7/1957 | Blank et al. | 423/245 S |
| 2,834,354 | 5/1958 | Rosenberg | 423/245 S |
| 2,920,416 | 1/1960 | Kinnauy | 423/245 S |
| 3,033,209 | 5/1962 | Touey | 423/245 S |
| 3,946,101 | 3/1976 | Harendza-Harinxma | 423/245 S |
| 4,194,517 | 3/1980 | Borowski | 131/334 |
| 4,489,739 | 12/1984 | Mattina, Jr. et al. | 131/334 |

FOREIGN PATENT DOCUMENTS 1119721 7/1968 United Kingdom .

*Primary Examiner*—Y. Harris-Smith

*Attorney, Agent, or Firm*—Wenderoth, Lind & Ponack

[57] ABSTRACT

The present invention provides a filter for use in association with cigarette tobacco, wherein the filter contains, as active component, at least one non-toxic inorganic or organic salt of a compound of the general formula:

$$H—S—X—SO_3H$$

in which X is a straight or branched alkylene radical containing 2 to 6 carbon atoms, and/or cysteine and/or acetylcysteine. The present invention also provides a cigarette and a cigarette holder comprising such a filter.

9 Claims, No Drawings

FILTER FOR REDUCING THE TOXIC EFFECTS OF CIGARETTE TOBACCO SMOKE

BACKGROUND OF THE INVENTION

It is well known that tobacco smoke contains a number of components which can have a harmful effect on smokers, especially when tobacco is smoked in the form of cigarettes.

One potentially harmful component of tobacco smoke is tar, but the tar content of cigarette smoke can be substantially reduced by using a tobacco which has a low tar content. In addition, it is well known to use filters which can either be integral with the cigarettes or which are present in a cigarette holder.

However, there are a number of potentially harmful components in cigarette smoke which are not removed by filters. These include not only hydrocyanic acid but also saturated and unsaturated aliphatic aldehydes, including acrolein, formaldehyde and acetaldehyde. Various health hazards have been ascribed to individual aldehydes: formaldehyde induces nasal cancers in rats, acetaldehyde has toxic effects on the myocardium and acrolein may induce bladder cancer and contribute to broncho-irritancy.

It is also known that certain anti-tumour agents are metabolised by the body to give metabolites which can themselves give rise to toxic lesions, many of which are highly organospecific. This highly undesirable side effect considerably restricts the therapeutic use and benefit of anti-tumour agents. Thus, by way of example, the well-known antineoplastic drug cyclophosphamide can give rise to haemorrhagic cystitis, this being due to the fact that cyclophosphamide is metabolised to give acrolein which is subsequently eliminated through the urinary system but which can give rise to neoplastic processes in the bladder.

Recent investigations have demonstrated that this highly undesirable effect of cyclophosphamide can be considerably or totally eliminated by the concurrent intravenous administation of ω-mercapto-alkane-sulphonates, preferably in the form of their non-toxic salts, such as the sodium salts thereof. Some of these compounds are known to be useful as mucolytic agents (see British Patent Specification No. 1 119 721).

Much effort has been devoted over the years to remove substances, such as acrolein and formaldehyde, from tobacco smoke but, despite these efforts, aldehyde reduction has not been achieved without concomitant unacceptable change in the taste characteristics.

We have now found that non-toxic salts of certain ω-mercapto-alkane-sulphonates, as well as cysteine and acetylcysteine, effectively lower the aldehyde and hydrocyanic acid content of tobacco smoke.

SUMMARY OF THE INVENTION

Thus, according to the present invention, there is provided a filter for use in association with cigarette tobacco, wherein the filter contains, as active component, at least one non-toxic inorganic or organic salt of a compound of the general formula:

$$H—S—X—SO_3H \quad (I)$$

in which X is a straight or branched alkylene radical containing 2 to 6 carbon atoms; and/or cysteine and/or acetylcysteine.

DETAILED DESCRIPTION OF THE INVENTION

Examples of inorganic salts of the compounds (I) include the sodium and potassium salts and examples of organic salts thereof include the 2-aminopyridine, morpholine and ethylenediamine salts.

A particularly preferred compound of general formula (I) is 2-mercaptoethane-sulphonic acid of the formula:

$$HS—CH_2—CH_2—SO_3H \quad (II)$$

which is preferably used in the form of its sodium salt. This compound is also known as mesna.

The amount of active component present in the filter according to the present invention is not critical but is preferably from 10 to 100 mg. and more preferably from 25 to 40 mg.

The association between the cigarette tobacco and the active component is achieved when the active component is present in a conventional type of filter which is either integral with the cigarette or is present in a cigarette holder. In the latter case, the filter present in a conventional holder can be in the form of a disposable or regeneratable filter.

In any case, the association according to the present invention is such that smoke inhaled from a cigarette passes through and comes into intimate contact with the active component.

When the active component is applied to a conventional cigarette filter which is integral with the cigarette, it is preferred to impregnate the filter with a solution of the active component, followed by evaporation of the solvent, whereafter the impregnated filter is combined with the cigarette rod in conventional manner. Alternatively, the active component can be mixed in solid form with conventional filter components.

When the active component is used in a filter present in a cigarette holder, it can be incorporated into a conventional filter capsule in solid form as the sole component thereof or as an additional component thereof. Conventional filter components used in filter capsules include active carbon, silicates and zeolites, all of which can be readily mixed with the active component.

Preliminary experiments which have been carried out show that the association according to the present invention does not result in an unacceptable pressure drop, i.e. the cigarette can be smoked in a conventional manner. Furthermore, the presence of the active component does not impair the flavour of the cigarette.

It has been found that the association according to the present invention results in a significant decrease in the tobacco smoke of hydrocyanic acid and of aldehydes and especially of acrolein, formaldehyde and acetaldehyde.

One of the preferred active components used according to the present invention is the above-mentioned compound mesna. This compound is commercially available. It has been administered to humans by intravenous injection and the full toxicology of the substance has been done. Mesna was initially used as a mucolytic and, for this purpose, it is used by aerosol instillation directly into the lungs. No side effects have been noticed by treatment in this way and it is evident, therefore, that the substance can be given directly to humans without any problems of inhalation toxicology.

It appears, however, from the 3rd Report of the Froggatt Committee on Smoking and Health, published by the Department of Health and Social Security, that evaluation of additives to tobacco products only comes under the scrutiny of this committee when the additives are substances intended to be burnt. However, the active components used according to the present invention are not intended to be burnt and are used as components of filters. Therefore, a full toxicology evaluation should not be required. Even if the active components were inhaled, because of their high mucolytic activity, they would probably be of therapeutic benefit to most smokers.

The preferred active component mesna is a white powder which is easy to synthsise and has a good storage stability. It is preferably used in the fully purified form as it is marketed for therapeutic use. Mesna is also practically odourless. With inorganic and organic bases, mesna forms stable, odourless salts which have clearly determined physical constants and, in particular, sharp melting points.

The following experimental results, which are given by way of example, demonstrate the advantages provided by the present invention:

EXPERIMENTAL RESULTS

Reduction of noxa

Mesna was sprinkled directly into cigarette filters. The filters were not ventilated and were connected with tobacco rods. The average amount of mesna powder per filter was about 25 mg. The cigarettes were smoked on standard machines to internationally recognised standards (35 ml. puffs of 2 seconds duration taken every 60 seconds). Drawing air through these filters resulted in reductions of 25% of the formaldehyde, 15% of the acrolein and 10% of the hydrocyanic acid.

The powder was merely sprinkled into the filters and, therefore, presented a granular surface on which the noxa referred to above were presumably absorbed.

Since it was highly probable that, if the mesna were present in a form which resulted in a greater surface area to weight ratio, then a larger reduction could be achieved even with a quite small dose, further experiments were carried out using solutions of mesna in distilled water.

A 25 mg. mesna solution was injected into the centre of each filter and the filters allowed to stand for 24 hours to dry and adjust under controlled conditions. These filters were then tested in the same way as the previous batch which contained dry mesna powder. Surprisingly, the results revealed a concentration drop in formaldehyde, acrolein and hydrocyanic acid which was almost identical to that seen with the previously tested filters.

Acceptability

A panel of 6 smokers were assembled who sprinkled 25 mg. mesna into filters which were then incorporated into hand-rolled cigarettes. All 6 noticed that the tobacco, which was of the same brand as they normally smoked, became milder and more agreeable. They all enjoyed the cigarettes until the ash reached the filter. Burning of the filter containing mesna produced an unpleasant taste but, provided they did not allow the cigarette to reach and burn the filter, the results were highly satisfactory.

The implications of this could be that tobacco now normally unacceptable might be usable. These results are also compatible with the chemical results in that a reduction of formaldehyde and/or acrolein and other aldehydes would make for a much less irritant smoke. This would be noticeable even by a long-time smoker.

Since the irritant qualities of the tobacco smoke are reduced, this will manifest itself in an appreciably less ciliostatic activity and will, therefore, be of benefit in two major ways to the health of the smoker:

1. it will permit the ciliary activity to remove more insoluble, noxious materials, such as tars, and 2. it will reduce the content of any of the noxa, which themselves may be either mutagenic, carcinogenic or co-carcinogens, to below a threshold where they would exert any malignant change.

In a further series of experiments in which approximately 25 mg. of mesna were incorporated into a cigarette filter, there was determined a reduction in the smoke of hydrocyanic acid content of 10%, of total aldehydes of 20%, of acrolein of 15% and of formaldehyde of 25%.

Repetition of these experiments but using 40 mg. of mesna in a filter resulted in a reduction of formaldehyde of 34% and of acrolein of 24%.

I claim:

1. A filter for use in association with cigarette tobacco, wherein the filter contains, as active component, at least one non-toxic inorganic or organic salt of a compound of the general formula:

$$H—S—X—SO_3H$$

in which X is a straight or branched alkylene radical containing 2 to 6 carbon atoms, and/or cysteine and/or acetylcysteine.

2. A filter according to claim 1, wherein the active compound is present in the form of a sodium or potassium salt or of a salt with 2-aminopyridine, morpholine or ethylenediamine.

3. A filter according to claim 1, wherein the active compound is 2-mercaptoethane-sulphonic acid or the sodium salt thereof.

4. A filter according to claim 1, wherein said filter contains from 10 to 100 mg. of active component.

5. A filter according to claim 4, wherein said filter contains from 25 to 40 mg. of active component.

6. A filter according to claim 1, wherein said filter is integral with a cigarette.

7. A filter according to claim 1, wherein the filter is present in or is adapted to be placed in a cigarette holder.

8. A cigarette comprising a filter according to claim 1.

9. A cigarette holder comprising a filter according to claim 1.

* * * * *

REEXAMINATION CERTIFICATE (687th)

United States Patent [19]

Caseley

[11] B1 4,532,947

[45] Certificate Issued May 26, 1987

[54] FILTER FOR REDUCING THE TOXIC EFFECTS OF CIGARETTE TOBACCO SMOKE

[75] Inventor: Jane R. Caseley, Withyham, England

[73] Assignee: Windleshaw Enterprises Limited, East Sussex, England

Reexamination Request:
No. 90/001,076, Aug. 25, 1986

Reexamination Certificate for:

| | |
|---|---|
| Patent No.: | **4,532,947** |
| Issued: | **Aug. 6, 1985** |
| Appl. No.: | **610,084** |
| Filed: | **May 9, 1984** |

[30] Foreign Application Priority Data

May 12, 1983 [GB] United Kingdom ..... 8313044

[51] Int. Cl.[4] ..... A24D 1/18; A24D 3/00; A24D 3/02; A24D 3/06

[52] U.S. Cl. ..... 131/331; 131/334; 131/342; 423/245 S; 423/236

[58] Field of Search ..... 131/331, 334, 342, 344; 423/245 S, 236; 55/524, 387

[56] References Cited

PUBLICATIONS

Sato et al., British Journal of Cancer, 16, 7-15 (1962).
Neri et al., Beitrage Zur Tabakforschung International, vol. 12, No. 2, Jun., 1983, pp. 73-79.
Benedict et al., Beitrage Zur Tabakforschung, 6, 189-193 (1972).
Benedict et al., Tobacco Science, 13, 166-168 (1969).
Neri et al., CORESTA Information Bulletin, 1982, CORESTA Symposium, Winston Salem, North Carolina, Oct. 31-Nov. 4, 1982.
Braven et al., British Journal of Cancer, 21, 623-633 (1967).
Neri et al., CORESTA Information Bulletin 1980, Abstracts of Papers presented at the 7th International Tobacco Scientific Congress, Manila, 1980.

*Primary Examiner*—William R. Dixon, Jr.

[57] ABSTRACT

The present invention provides a filter for use in association with cigarette tobacco, wherein the filter contains, as active component, at least one non-toxic inorganic or organic salt of a compound of the general formula:

$$H-S-X-SO_3H$$

in which X is a straight or branched alkylene radical containing 2 to 6 carbon atoms, and/or cysteine and/or acetylcysteine. The present invention also provides a cigarette and cigarette holder comprising such a filter.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–9, dependent on an amended claim, is determined to be patentable.

1. A filter for use in association with cigarette tobacco, wherein the filter contains, as active component, at least one non-toxic inorganic or organic salt of a compound of the general formula:

$$H—S—X—SO_3H$$

in which X is a straight or branched alkylene radical containing 2 to 6 carbon atoms[, and/or cysteine and/or acetylcysteine].

* * * * *